United States Patent [19]

Ando et al.

[11] Patent Number: 4,594,953

[45] Date of Patent: Jun. 17, 1986

[54] BUTTON SEWING MACHINE

[75] Inventors: Hideo Ando; Hideo Kawaguchi; Yasuhiko Watanabe, all of Nagoya, Japan

[73] Assignee: Brother Kogyo Kabushiki Kaisha, Nagoya, Japan

[21] Appl. No.: 770,035

[22] Filed: Aug. 27, 1985

[30] Foreign Application Priority Data

Sep. 5, 1984 [JP] Japan ..... 59-185746

[51] Int. Cl.[4] ..... D05B 3/14

[52] U.S. Cl. ..... 112/112; 112/113; 112/114

[58] Field of Search ..... 112/110, 111, 112, 113, 112/114

[56] References Cited

U.S. PATENT DOCUMENTS 2,830,549 4/1958 Troll ..... 112/113

2,967,497 1/1961 Braun et al. ..... 112/113

3,382,824 5/1968 Bronfman ..... 112/113

3,499,405 3/1970 McKee et al. ..... 112/113

3,837,530 9/1974 Snyder ..... 112/113

*Primary Examiner*—Ronald Feldbaum

*Attorney, Agent, or Firm*—Jordan and Hamburg

[57] ABSTRACT

A button sewing machine has a sewing needle reciprocatingly movable in response to rotation of a main shaft and a button gripping assembly having gripping portions for gripping and releasing a button and movable across the path of reciprocating travel of the sewing needle, the sewing needle and the button gripping assembly being operable together for sewing the button to a fabric. The button sewing machine includes a detector for detecting whether the button is gripped by the gripping portions. After it has been confirmed that the button is gripped by the gripping portions, the main shaft is driven by a control assembly for enabling the sewing needle to sew the button to the fabric.

11 Claims, 7 Drawing Figures

BUTTON SEWING MACHINE

BACKGROUND OF THE INVENTION

1. Field of the Invention:

The present invention relates to a button sewing machine for sewing a button to a fabric through cooperation between a sewing needle reciprocatingly movable along a needle path by the rotation of the main shaft of the sewing machine and a button gripping means movable across the needle path on the bed of the sewing machine, and more particularly to a button sewing machine having a detector means for detecting the condition in which a button is properly gripped by the button gripping means.

2. Description of the Prior Art:

Button sewing machines are generally provided with a button feed device for automatically feeding buttons one by one to the sewing point on the sewing machine. For example, button feed devices disclosed in U.S. Pat. Nos. 2,830,549 and 3,382,824 have a chute extending obliquely from a button supply hopper to the sewing point for guiding a row of buttons slidably therealong. The buttons are successively stitched to a fabric as the sewing needle is moved up and down at the sewing point.

When the button supply hopper runs short of buttons or the chute is jammed with buttons, so that no button can be supplied any longer, or when a button fed to the sewing point is not properly held in position and hence cannot be clamped, button-free stitches with no button sewn thereby are formed on the fabric as the sewing operation progresses. With the conventional button sewing machines, therefore, the operator is always required to pay attention to the manner in which the buttons are fed. As a result, the button sewing operation cannot be automatized or still needs an expenditure of manual labor.

SUMMARY OF THE INVENTION

It is a primary object of the present invention to provide a novel button sewing machine capable of reliably preventing button-free stitches from being formed on a fabric.

Another object of the present invention is to provide a button sewing machine capable of reliably detecting whether a button is present or not only upon a button supply failure in a button feeding device but also upon a button gripping failure in a button gripping means.

Still another object of the present invention is to provide a button sewing machine having a detector means in which the sensor is not required to change its attached position even when the distance between the gripping portions of a pair of button gripping arms is varied dependent on the button size at the time buttons are fed.

To achieve the aforesaid objects, a button sewing machine according to the present invention includes a detector means for detecting whether a button is gripped by the gripping portions of a button gripping means, and a control means responsive to a button-indicating signal from the detector means for driving the main shaft of the sewing machine to enable a sewing needle to sew the button.

In a preferred embodiment of the present invention, the detector means detects the presence of a button based on the position of a pair of button gripping arms as they grip the button, and detects the absence of a button based on the position of the button gripping arms as they do not grip a button.

The detector means is preferably composed of a member to be detected on an interlinking member operable in response to opening and closing movements of the button gripping arms, and a sensor for detecting movement of the member to be detected. The member to be detected is held in a constant position at all times with respct to the sensor when the button gripping arms are closed at the time the distance bewteen the gripping portions of the button gripping arms is adjusted dependent on the size of the button.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 5:
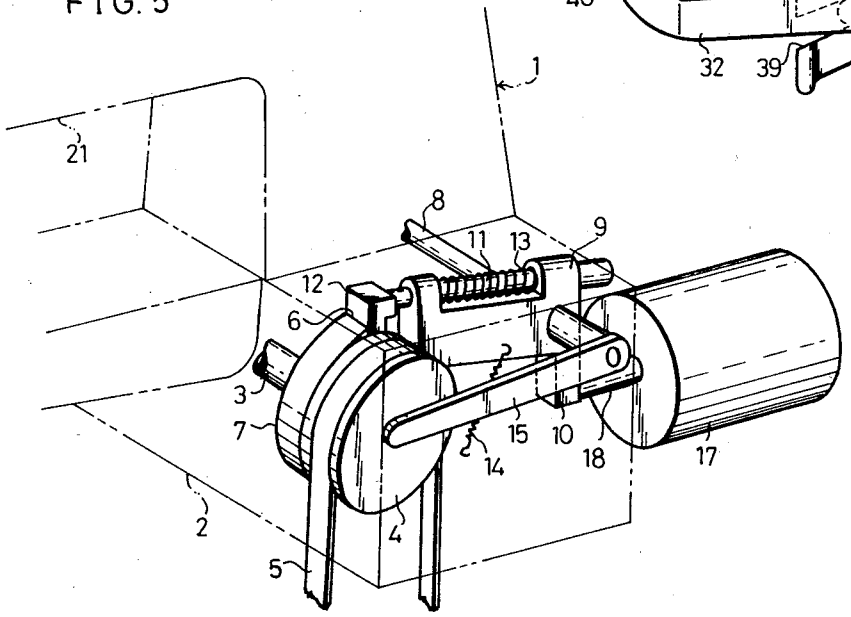
FIG. 5 is a perspective view of a sewing machine drive assembly.

As shown in FIG. 5, a main shaft 3 is rotatably supported in a bed 2 of a sewing machine frame 1. A pulley 4 is mounted on one end of the main shaft 3 for idling rotation and axially slidable movement thereon and is operatively coupled by a belt 5 to a drive source such as a sewing machine drive motor (not shown). A control disk 7 having a peripheral stepped engaging portion 6 is fixed to the main shaft 3 adjacent to the pulley 4. A clutch mechanism (not shown) comprising a spring clutch or the like is interposed between the control disk 7 and the pulley 4.

A support shaft 8 extending in the frame 1 parallel to the main shaft 3 is supported for rotation about its own axis, with a control lever 9 secured to the support shaft 8. An engaging projection 10 extends downwardly from the secured end of the control lever 9. An engaging pin 11 is axially slidably supported on an upper end of the control lever 9. To one end of the engaging pin 11, there is attached an engaging member 12 for engaging the engaging portion 6 of the control disk 7. A compression spring 13 is disposed around the engaging pin 11 for normally urging the engaging member 12 in a direction toward the engaging portion 6. The control lever 9 is normally urged by a tension spring 14 to turn counterclockwise as shown in FIG. 5. A presser lever 15 is fixed to the front end of the support shaft 8 and has a distal end held against the pulley 4 through a cam (not shown). When the presser lever 15 is swung upon reciprocating angular movement of the support shaft 8, the pulley 4 is caused by the cam to move on the main shaft 3 toward and away from the control disk 7.

A drive member comprising a control solenoid 17 is mounted on an outer surface of the bed 2 and has a plunger 18 held in abutment against the engaging projection 10 of the control lever 9. When the control solenoid 17 is energized by a start switch 19 (FIG. 6) in response to a stepping by the operator, the plunger 18 projects out to turn the control lever 9 and the engaging pin 11 clockwise against the force of the tension spring 14. Therefore, the engaging member 12 is released from the engaging portion 6 of the control disk 7, and at the same time the turning movement of the presser lever 15 causes the cam to move the pulley 4 in the direction away from the control disk 7. The clutch mechanism is then engaged to transmit the rotation of the pulley 4 to the control disk 7 to rotate the main shaft 3. When the plunger 18 is retracted by de-energization of the control solenoid 17, the control lever 9 and the engaging pin 11 are turned counterclockwise until the engaging member 12 is engaged by the engaging portion 6, and the pulley 4 is pushed by the presser lever 15 toward the control disk 7. The clutch mechanism is now disengaged, and the main shaft 3 is immediately stopped by a brake mechanism (not shown) while the pulley 4 is being rotated by the sewing machine drive motor, so that a sewing needle 23 (described later) is held at rest in an upper limit position or top dead center. The clutch mechanism and a drive mechanism for engaging and disengaging the same are well known in the art.

Figure 1:
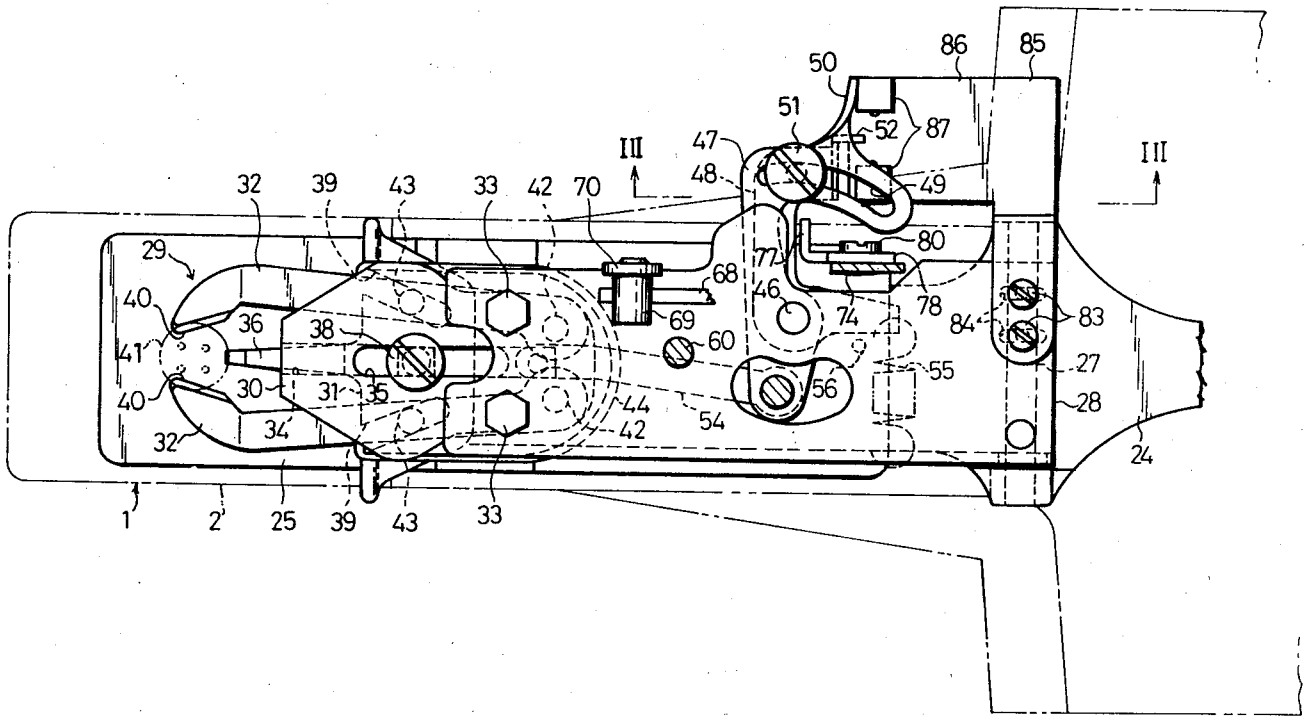
FIG. 1 is a fragmentary plan view of a button sewing machine according to an embodiment of the present invention.
Figure 2:
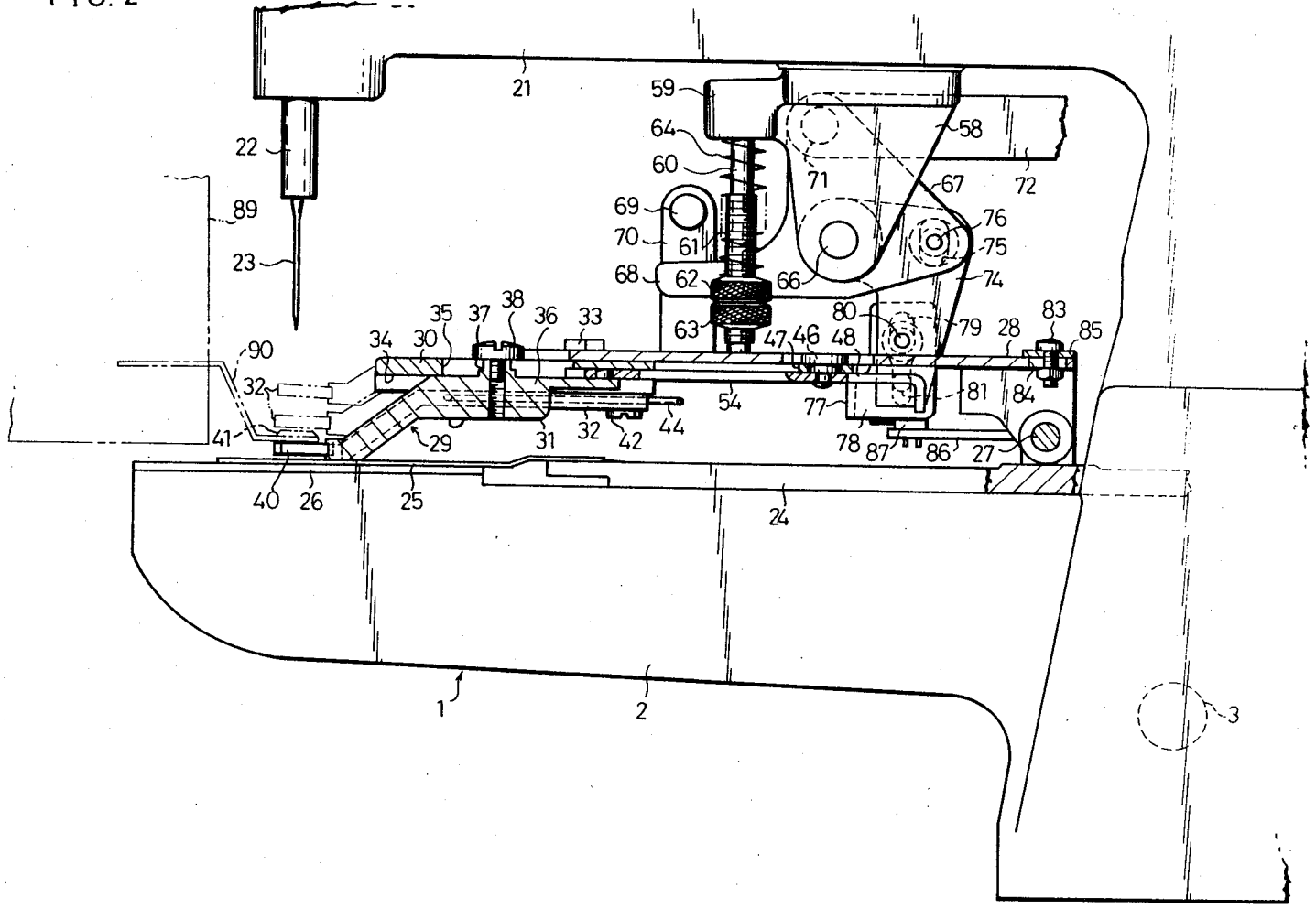
FIG. 2 is a fragmentary side elevational view, partly in cross section, of the button sewing machine shown in FIG. 1.

As illustrated in FIGS. 1 and 2, a needle bar 22 with the sewing needle 23 supported on its lower end is supported on the front end of an arm 21 of the frame 1, the needle bar 22 being vertically movable in response to rotation of the main shaft 3. A looper (not shown) of a known construction is rotatably mounted in the bed 2 in vertically aligned relation to the needle bar 22 for cooperating with the sewing needle 23 in forming stitches. A feed table 24 is supported on the bed 2 for back-and-forth and lateral movements thereon. A feed plate 25 is attached to the distal end of the feed table 24 and extends in a forward direction below the sewing needle 23. A needle plate 26 is mounted on the upper surface of the bed 2 in underlying relation to the feed plate 25. A presser arm 28 is angularly movably supported at its rear end on a shaft 27 in overlying relation to a substantially central portion of the feed table 24. A button gripping means 29 is mounted on the front end of the presser arm 28 for back-and-forth and lateral movements across the vertical path of the sewing needle 23 in response to the movement of the feed table 24.

The button gripping means 29 is composed of a support body 30, a slide member 31, and a pair of button gripping arms 32. The support body 30 is attached by a pair of screws 33 to the lower surface of the front distal end of the presser arm 28. The support body 30 has a longitudinal guide groove 34 defined substantially centrally in the lower surface thereof, and also has a longitudinal slot 35 defined in the upper surface thereof in communication with the guide groove 34. The slide member 31 has a body 36 longitudinaly slidably accommodated in the guide groove 34, the body 36 having a projection 37 extending from the upper central portion thereof and fitted in the slot 35. A screw 38 is threaded downwardly into the projection 37 to retain the slide member 31 on the support body 30. The position of the slide member 31 in the longitudinal direction can be adjusted by loosening and tightening the screw 38.

Figure 4:
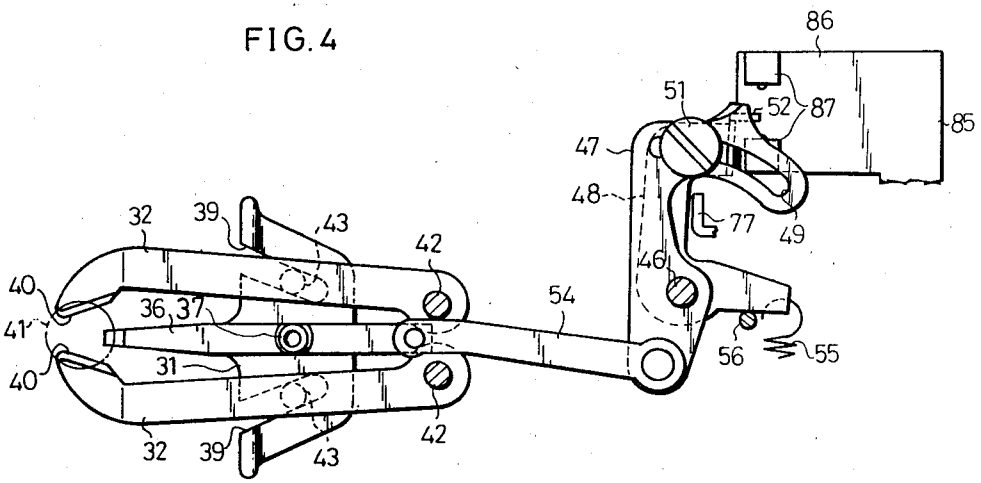
FIG. 4 is a plan view showing a pair of button gripping arms and a detector means as they are interlinked.

As shown in FIGS. 1 and 4, the slide member 31 has a pair guide grooves 39 defined in laterally spaced portions thereof and opening at the front end thereof, the guide grooves 39 being inclined rearwardly and inwardly. The button gripping arms 32 are positioned between the support body 30 and the slide member 31 and extend longitudinally in confronting parallel relation to each other, the button gripping arms 32 being angularly movably supported to the lower surface of the support body 30 by a pair of rear stepped screws 42. The button gripping arms 32 have on their front ends a pair of respective gripping portions or surfaces 40 positioned one on each side of the vertical path of the sewing needle 23 for gripping and releasing a button 41. A pair of engaging pins 43 projects from the substantially central lower surfaces of the button gripping arms 32 and engages in the guide grooves 39, respectively. A U-shaped spring 44 has its opposite ends engaging the outer surfaces of the button gripping arms 32, respectively, for normally urging the button gripping arms 32 in the closing direction.

An adjustment lever 47 is angularly movably supported at its central portion on a shaft 46 projecting downwardly from the rear end of the presser arm 28. A substantially L-shaped follower lever 48 is angularly movably supported at its central bent portion on the shaft 46 below the adjustment lever 47. The adjustment lever 47 has an arcuate slot 49 defined in its lefthand end and an actuating member 50 projecting to the left from the lefthand end. A connecting member comprising a screw 51 is threaded downwardly through the slot 49 into the lefthand end of the follower lever 48. The levers 47, 48 are coupled together by the screw 51 and can be positionally adjusted relatively to each other by loosening and tightening the screw 51. A projecting member 52 is bent rearwardly from the rear end of the lefthand side of the follower lever 48.

A connecting link 54 is interposed between the righthand end of the adjustment lever 47 and the upper surface of the rear end of the body 36 of the slide member 31. As shown in FIG. 1, the follower lever 48 is normally urged to turn clockwise by a tension spring 55 (not shown in FIG. 2) interposed between the follower lever 48 and the presser arm 28. A stop pin 56 projects downwardly from the lower surface of the presser arm 28 for engaging the follower lever 48 to prevent the same from turning clockwise.

The adjustment lever 47, the follower lever 48, and the screw 51 jointly constitute an adjustment mechanism. When the levers 47, 48 are rendered relatively angularly movable by loosening the screw 51 and the adjustment lever 47 is turned counterclockwise in FIG. 1 by the actuating member 50, the slide member 31 is moved backwards along the guide groove 34 through the connecting link 54. Therefore, the button gripping arms 32 are turned in the opening direction against the bias of the spring 44 by the engaging pins 43 engaging in the guide grooves 39 of the slide member 31. As a consequence, the distance between the gripping portions 40 of the button gripping arms 32 can be adjusted dependent on the size of the button 41 through the above process. During the adjustment process, the follower lever 48 is kept by the tension spring 55 in a fixed position in which it is engaged by the stop pin 56. The adjustment lever 47, the follower lever 48, and the connecting link 54 jointly serve as an interlinking assembly.

When the follower lever 48 is turned by an opening and closing means (described later) with the levers 47, 48 being coupled for movement in unison, the button gripping arms 32 can be opened and closed in coaction with the follower lever 48 through the adjustment lever 47 and the connecting link 54 for gripping and releasing the button 41 between the gripping portions 40.

The opening and closing means will be described hereinbelow.

As shown in FIG. 2, a support bracket 58 is attached to the lower surface of the arm 21 of the frame 1 and has a front projecting nose 59 supporting a presser rod 60 for vertical movement. The presser rod 60 has a threaded portion 61 over which there are threaded a nut-like spring seat 62 and a nut-like locking member 63 that are vertically adjustable in position. A compression spring 64 is disposed around the presser rod 60 between the spring seat 62 and the projecting nose 59 for normally urging the presser rod 60 to move downwardly. The slide member 31 supported on the presser arm 28 is pressed down against the bed 2 through the engagement between the lower end of the presser rod 60 and the upper surface of the presser arm 28.

A substantially triangular swing member 67 is angularly movably supported on a shaft 66 projecting from the lower end of the support bracket 58, the swing member 67 having a projecting portion 68 projecting forwardly from the front end thereof. An upstanding member 70 is mounted on the lefthand side of the presser arm 28 and has an engaging shaft 69 on the upper end thereof. An actuating rod 72 is pivotally supported at its front end on a shaft 71 on the upper end of the swing member 67. The actuating rod 72 has a rear end operatively connected to a presser arm actuating mechanism (not shown) which is operable upon rotation of the main shaft 3. The swing member 67 is angularly movable about the shaft 66 in response to back-and-forth movement of the actuating rod 72.

A substantially L-shaped inverted actuating member 74 is angularly movably supported at its front end on the shaft 66 of the support bracket 58. The actuating member 74 is positionally adjustably connected to the swing member 67 by means of a stepped screw 76 in an oblong hole 75 defined in the central bent portion of the actuating member 74. As shown in FIGS. 1 and 2, a drive member comprising an actuating piece 78 has an engaging portion 77 engageable with the rear edge of the follower lever 48 and is attached to the lower end of the actuating member 74. The actuating piece 78 is capable of vertical fine positional adjustment with respect to the actuating member 74 through an oblong hole 79, a stepped screw 80, and a positioning pin 81.

The swing member 67, the actuating rod 72, the actuating member 74, and the actuating piece 78 jointly constitute the opening and closing means which operates to open and close the button gripping arms 32 through the interlinking assembly.

Figure 3:
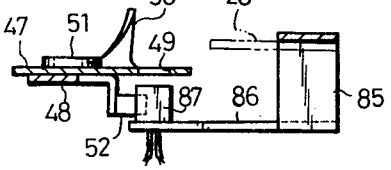
FIG. 3 is a cross-sectional view taken along line III—III of FIG. 1.

As illustrated in FIGS. 1 and 3, a sensor support body 85 is attached to the upper surface of the rear end of the presser arm 28 and positionally adjustable in the longitudinal direction by adjustment screws 83 and oblong holes 84 in which the adjustment screws 83 are fitted. The sensor support body 85 includes a support plate 86 supporting on its front upper surface a sensor 87 such as a photointerrupter or the like composed of members disposed one on each side of the projecting member 52 which serves as a member to be detected. The position of the sensor 87 with respect to the projecting member 52 can be adjusted appropriately by positional adjustment of the sensor support body 85.

When the button 41 is gripped between the gripping portions 40 of the button gripping arms 32, as shown in FIG. 1, the follower lever 48 is turned counterclockwise in response to the turning movement of the button gripping arms 32 in the opening direction, so that the projecting member 52 of the follower lever 48 opens the light path of the sensor 87. When the button 41 is not gripped between the gripping portions 40 of the button gripping arms 32, as shown in FIG. 4, the follower lever 48 is turned clockwise from the position in which the button 41 is gripped, in response to the closing movement of the button gripping arms 32, so that the projecting member 52 shuts off the light path of the sensor 87. Since the follower lever 48 in the aforesaid adjustment mechanism is adjustable in position with respect to the adjustment lever 47, the follower lever 48 is held in engagement with the stop pin 56 under the bias of the tension spring 55 even when the angular position of the adjustment lever 47 is varied in adjusting the distance between the button gripping arms 32 dependent on the size of the button 41. Therefore, the projecting member 52 and the sensor 87 are kept in a constant relative position at all times when the button gripping arms 32 are closed.

As shown in FIG. 2, a button feed device 89 is disposed in the vicinity of the button sewing machine, the button feed device 89 having a button supply hopper (not shown) containing a number of buttons 41. A feed arm 90 is angularly movably mounted on the button feed device 89 and has a distal end movable between a button receiving position spaced from the button gripping arms 32 and a button delivery position confronting the button gripping arms 32. When the button gripping arms 32 as they are open is in a substantially intermediate position in its upward movement range upon completion of one sewing cycle, the feed arm 90 is turned from the button receiving position to the button delivery position in which a button 41 is fed from the distal end of the feed arm 90 upwardly into a position between the gripping arms 32.

Figure 6:
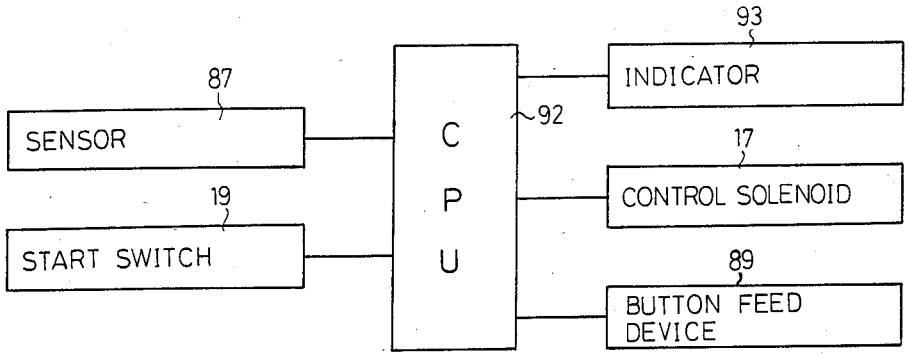
FIG. 6 is a block diagram of a portion of an electric circuit for controlling the button sewing machine.

FIG. 6 shows a portion of an electric circuit for the button sewing machine. The electric circuit has a central processing unit (hereinafter referred to as a "CPU") 92 including a memory device and connected to the control solenoid 17, the start switch 19, the sensor 87, the button feed device 89, and an indicator 93. The indicator 93 has a suitable alarm means such as a lamp, a buzzer or the like for informing the operator of a button feed failure when the button 41 is not properly fed between the button gripping arms 32. The clutch mechanism disposed between the sewing machine drive motor and the main shaft 3, the control solenoid 17 for connecting and disconnecting the clutch mechanism, and the CPU 92 jointly constitute a control means in the above embodiment. When a button-indicating signal is issued from the sensor 87 at the time of feeding the button 41, the CPU 92 energizes the control solenoid 17 to engage the clutch mechanism for rotating the main shaft 3 to enable the sewing needle 23 to sew the button 41.

Operation for sewing the button 41 to a fabric on the button sewing machine will be described hereinbelow.

In FIG. 2, the actuating rod 72 is in the forward position in which the projecting portion 68 of the swing member 67 is spaced downwardly from the engaging shaft 69 of the presser arm 28. Therefore, the front end of the slide member 31 is pressed against the feed plate 25 by the presser arm 28 under the force of the compression spring 64 on the presser rod 60. The fabric (not shown) is therefore gripped between the slide member 31 and the feed plate 25.

The engaging portion 77 of the actuating piece 78 is spaced from the rear edge of the follower lever 48 by the actuating member 74 as shown in FIG. 1. The button 41 is gripped between the gripping portions 40 of the button gripping arms 32. The follower lever 48 is urged by the tension spring 55 to turn clockwise (FIG. 1) for pressing the slide member 31 in the forward direction through the adjustment lever 47 and the connecting link 54. Therefore, the button gripping arms 32 are urged to turn in the closing direction through the engagement of the engaging pins 43 in the guide grooves 39.

As the main shaft 3 rotates under this condition, the presser arm 28 and the button gripping arms 32 are moved with the feed table 24 in the back-and-forth and lateral directions, and the sewing needle 23 and the non-illustrated looper are operated to sew the button 41 to the fabric.

When one sewing cycle is completed, the presser arm actuating mechanism is operated to turn the swing member 67 clockwise in FIG. 2. The actuating piece 78 of the actuating member 74 then engages the rear edge of the follower lever 48 for angularly moving the follower lever 48 and the adjustment lever 47 counterclockwise (FIG. 1) against the resiliency of the tension spring 55. At the same time, the slide member 31 is moved back by the connecting link 54. The button gripping arms 32 are turned from the gripping position in the opening direction against the spring force of the spring 44 through the engagement of the engaging pins 43 of the button gripping arms 32 in the guide grooves 39 of the slide member 31. The inner edges of the gripping portions 40 are now spaced from the button 41.

Continued rearward movement of the actuating rod 72 causes the swing member 67 to turn clockwise in FIG. 2, whereupon the projecting portion 68 engages the lower surface of the engaging shaft 69. Then, the presser arm 28 is moved upwardly against the bias of the compression spring 64 to displace the button gripping arms 32 and the slide member 31 away from the fabric. While the button gripping arms 32 ascend, a next button 41 is supplied between the gripping portions 40 by the feed arm 90 of the button feed device 89.

As the button gripping arms 32 further move upwardly from the button feeding position, the follower lever 48 is released from the engaging portion 77 of the actuating piece 78 and turned clockwise in FIG. 1 together with the adjustment lever 47. Therefore, the button gripping arms 32 are closed via the connecting link 54, the slide member 31, the guide groove 39, and the engaging pins 43 to grip the button 41 between the gripping portions 40.

When the button 41 is thus gripped, the light path of the sensor 87 is opened to enable the latter to confirm the presence of the button 41. The clutch mechanism is now engaged by the control solenoid 17. Upon rotation of the main shaft 3, the actuating rod 72 is moved forwardly to turn back the swing member 67 and the actuating member 74 counterclockwise in FIG. 2. Consequently, the slide member 31 is forced against the fabric by the compression spring 64, and the actuating piece 78 is brought to the lower position in which it is engageable with the follower lever 48. Thereafter, the sewing needle 23 and the feed table 24 are actuated to stitch the button 32 gripped between the button gripping arms 32 to the fabric.

Figure 7:
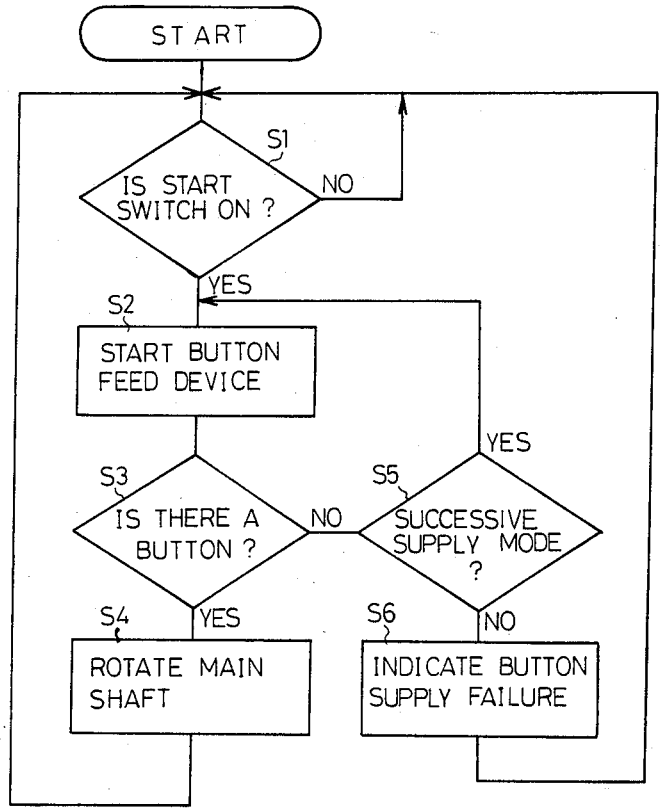
FIG. 7 is a flowchart of a portion of a control program for the electric circuit.

Operation of the button sewing machine upon a button supply failure will be described with reference to FIG. 7. FIG. 7 is a flowchart of a program executed by the CPU 92 for controlling the button sewing machine. If actuation of the start switch 91 is confirmed in a step S1, the button feed device 89 is started in a step S2 to enable the feed arm 90 to feed a button 41. Then, a step S3 ascertains whether the button 41 is present or not between the gripping portions 40 of the button gripping arms 32 as closed based on a detected signal from the sensor 87. If the button 41 is properly gripped between the button gripping arms 32, then the program goes to a step S4 in which the control solenoid 17 is energized to rotate the main shaft 3 for sewing the button 41 to the fabric.

Sometimes, the button supply hopper may be empty, or the button feed device 89 may be jammed with buttons and fail to supply a button, or the fed button 41 is not properly gripped or clamped between the button gripping arms 32. Should such a situation happen, the button gripping arms 32 are turned in the closing direction through an angle larger than the angle at which a button is gripped between the button gripping arms 32. Therefore, the follower lever 48 is turned clockwise (FIG. 1) by the connecting link 54 and other members until the follower lever 48 engages the stop pin 56, whereupon the projecting member 52 shuts off the light path of the sensor 87, which then detects the absence of a button.

If the absence of a button is confirmed, then the program proceeds to a step S5 which determines whether the sewing machine is in a successive button supply mode or not. If in the successive button supply mode, then the program goes back to the step S2 in which the button feed device 89 is driven again to repeat the button feeding operation. If not in the successive button supply mode, then the alarm means of the indicator 93 is energized in a step S6 to give a button supply failure message to the operator. When the operator removes the cause of the button feed failure, the program returns to the step S1 and waits for actuation of the start switch 19.

Unlike the conventional button sewing machines, the sewing needle 23 is prevented from continuing its sewing operation and no button-free stitches are formed on the fabric when a button fails to be supplied. Therefore, a defective sewn product is prevented from being produced. Therefore, where the button sewing machine of the invention is incorporated in a sewing apparatus which is designed for automatically sewing buttons successively to a fabric such as the front part of a garment by alternately repeating the feed of the fabric and the button sewing cycle, the sewing apparatus can smoothly be operated continuously without requiring the operator to always confirm how the buttons are supplied at the sewing position. As a consequence, the manual labor involved in the button sewing operation is greatly reduced, or the button sewing operation can be automazied. Since the sensor 87 is arranged to detect the projecting member 52 of the follower lever 48 which operates in response to the gripping and releasing movements of the button gripping arms 32, a button clamp failure or error at the button gripping arms 32 as well as a button feed failure can be detected without fail.

The present invention is not limited to the illustrated details of the foregoing embodiment. The sensor 87 may be attached in different positions, such as in the vicinity of the gripping portions 40 of the button gripping arms 32 for directly ascertaining whether a button 41 has been supplied or not.

Although a certain preferred embodiment has been shown and described, it should be understood that many changes and modifications may be made therein without departing from the scope of the appended claims.

What is claimed is:

1. A button sewing machine comprising:

a frame including a bed;

a main shaft rotatably supported by said frame and drivable by a drive source;

a sewing needle responsive to rotation of said main shaft for reciprocating movement along a path to sew a button to a fabric;

button gripping means having gripping portions for gripping and releasing the button on said path and movable on said bed across said path in response to rotation of said main shaft;

detector means for ascertaining whether the button is gripped by said gripping portions; and control means for driving said main shaft to enable said sewing needle to sew the button to the fabric in response to a signal generated by said detector means when the button is gripped by said gripping portions.

2. A button sewing machine according to claim 1, wherein said button gripping means includes a pair of button gripping arms, including opening and closing means for opening and closing said button gripping means, said gripping portions comprising distal ends of said button gripping arms positioned one on each side of said path.

3. A button sewing machine according to claim 2, wherein said opening and closing means includes an adjustment mechanism for adjusting the distance between said distal ends of said button gripping arms as they are open, dependent on the size of the button.

4. A button sewing machine according to claim 3, wherein said opening and closing means has an actuating member, said adjustment mechanism comprising a follower lever mounted on a shaft for being angularly moved by said actuating member of said opening and closing means, said follower lever being limited in its angular movement in one direction, an adjustment lever supported on said shaft in superposed relation to said follower lever and angularly movable in response to opening and closing movements of said button gripping arms, and a connecting member connecting said follower lever and said adjustment lever in positionally adjustable relation to each other.

5. A button sewing machine according to claim 4, wherein said detector means includes means for detecting the presence of the button based on the position of said button gripping arms at the time the button is gripped by said gripping portions, and for detecting the absence of the button based on the position of said button gripping arms at the time said gripping portions do not grip the button and are more closed than when they grip the button.

6. A button sewing machine according to claim 5, wherein said detector means comprises a member to be detected on an interlinking member operable in response to opening and closing movements of said button gripping arms, and a sensor for detecting movement of said member to be detected.

7. A button sewing machine according to claim 6, wherein said interlinking member comprises said follower lever of said adjustment mechanism.

8. A button sewing machine according to claim 6, wherein said sensor comprises a photointerrupter.

9. A button sewing machine according to claim 1, wherein said control means comprises a clutch mechanism interposed between said drive source and said main shaft, a drive member for engaging and disengaging said clutch mechanism, and a central processing unit for operating said drive member to engage said clutch mechanism when a signal indicative of the button is issued by said detector means when the button is to be supplied.

10. A button sewing machine according to claim 9, including an indicator operable by said central processing unit for alarming a button supply failure when a signal indicative of the button is not issued by said detector means when the button is to be supplied.

11. A button sewing machine according to claim 9, including a button feed device for feeding the button, said central processing unit including means for restarting said button feed device to feed the button when a signal indicative of the button is not issued by said detector means when the button is to be supplied.

* * * * *